US005893252A

United States Patent [19]

Hardy, Jr. et al.

[11] Patent Number: 5,893,252

[45] Date of Patent: Apr. 13, 1999

[54] SYSTEM FOR AFFIXING REBAR LATTICE TO RECEIVE CONCRETE

[75] Inventors: Robert M. Hardy, Jr., Taylor Lake Village; Louis A. Waters, Jr., Bellaire, both of Tex.

[73] Assignee: Hardy Construction Technology, LLC, Seabrook, Tex.

[21] Appl. No.: 08/857,727

[22] Filed: May 16, 1997

Related U.S. Application Data

[63] Continuation-in-part of application No. 08/649,051, May 16, 1996.

[51] Int. Cl.[6] ..... E04C 5/16

[52] U.S. Cl. ..... 52/685; 52/679; 52/686; 52/687; 52/689; 52/719

[58] Field of Search ..... 52/677, 679, 684, 52/685, 686, 687, 688, 689, 719

[56] References Cited

U.S. PATENT DOCUMENTS

| | | |
|---|---|---|
| 1,613,351 | 1/1927 | Klinger et al. . |
| 3,105,423 | 10/1963 | Reiland . |
| 3,378,981 | 4/1968 | Horne . |
| 3,673,753 | 7/1972 | Anderson . |
| 3,788,025 | 1/1974 | Holmes . |
| 4,007,572 | 2/1977 | Ilukowicz . |
| 4,835,933 | 6/1989 | Yung . |
| 5,400,562 | 3/1995 | Bahr . |

OTHER PUBLICATIONS

Manual of Standard Practice, Concrete Reinforcing Steel Institute, 26th Edition, Jan. 1997.

*Primary Examiner*—Michael Safavi

*Attorney, Agent, or Firm*—Akin, Gump, Strauss Hauer & Feld

[57] ABSTRACT

An apparatus for fixating and elevating an interconnected rebar lattice having individual longitudinal and transverse rebar intersections for use as support for poured concrete in highway and other construction. The apparatus including a holding portion having an open ended recess with two opposing walls being generally U-shaped. The recess has a longitudinal axis and is sized and shaped to receive a longitudinal rod. An arc-shaped portion extends laterally outward from each opposing wall and perpendicular to the longitudinal axis of the recess. The arc-shaped portion has a transverse axis and is sized and shaped to receive a longitudinal rod. The arc-shaped portion includes a recess and opposing walls with each wall including a snap-type lock. A locking member has a generally arc-shaped portion and includes a snap-type lock for attaching to the arc-shaped portions and engaging with the snap-type lock of the arc-shaped portions. A leg portion extends downwardly from the holding portion and is integrally attached to a base.

31 Claims, 11 Drawing Sheets

SYSTEM FOR AFFIXING REBAR LATTICE TO RECEIVE CONCRETE

This application is a continuation-in-part of co-pending application Ser. No. 08/649,051 filed May 16, 1996.

FIELD OF THE INVENTION

This invention relates to a system for elevating a reinforcing bar lattice structure (or "rebar mat") that is known to be used as a reinforcement and support for poured concrete in roadway construction and other slab type construction, and more specifically to devices capable of supporting the rebar mat and of fastening together the individual rebar members to form a unitized rebar mat section, in such a manner as to prevent the rebar mat from rotating off the support devices and from experiencing angular deformation during the concrete pour.

BACKGROUND OF THE INVENTION

For many years concrete roadways and other concrete slabs have incorporated reinforcing steel laid out in a rectangular lattice pattern for the purpose of adding strength to the concrete in order to resist slab failure when cracks develop in the concrete due to normal environmental conditions and heavy use. When cracks in the concrete develop, the mat lattice structure of the reinforcing bars perform the function of holding the concrete together at the point of the cracks, preventing separation of the concrete and failure of the slab. In order for the reinforcing bars to effectively perform this function, however, engineers have determined that the rebar mat should be located at the center of the poured slab. The normal preferred location is in the center of the slab, referred to as Thickness/2 or t/2. The rebar mat must also retain its designed rectangular lattice shape in order for the longitudinal and transverse rebar sections to provide the maximum reinforcing strength at anticipated cracking areas, and in order for the rebar ends of each section to line up with the rebar ends of adjoining sections of rebar mat as additional lanes are constructed. For many years contractors and public road building engineers have been aware that current methods for building the rebar mat and elevating the mat off the surface of the roadbed or slab often fail to maintain the rebar mat in a rectangular shape and in the desired location within the slab after the placement of concrete which results in premature failure of the concrete road or slab.

Currently, rebar mats used in road construction are built using a three step method: (1) laborers lay out rebar sections on the roadbed in the location where the rebar mat section is to be assembled forming a template with the transverse bars spaced properly and usually 3, 4 or 5 longitudinal bars laid out on top of the transverse bars, and tied with wire at the rebar intersections to form the template; (2) once the template has been laid out and tied together with wire, the rebar template is lifted off the surface of the roadbed and devices, known as "rebar chairs, " are placed under each transverse bar in the rebar template, with an adequate number of rebar chairs being used to elevate the rebar mat to the desired height and then setting the rebar on top of the rebar chairs, usually in a slot built into the chair; and (3) placing the remaining longitudinal rebar sections on top of the elevated template, and wire tying them at alternating intersections to complete construction of the rebar mat.

This traditional method for building rebar mats is deficient in two major respects. First, the rebar chairs are held upright by the base of the chair sitting on the roadbed and are not firmly locked to the rebar mat sections. When lateral forces, common on the job site, are exerted against the rebar mat, the chairs can rotate off of or around the rebar mat section and the entire rebar mat can fall to the roadbed. This situation can also occur during the pouring of the concrete when the lateral forces exerted by the in-flowing concrete can wash the rebar chairs out from under the rebar mat causing the mat within the slab to sag to the ground where the chairs have failed after the concrete is poured. Second, the wire tied rebar intersections provide no strength against angular deflection of the rebar, known as racking, when extreme forces of the concrete placement and the paving vibrator are applied. This method of mat construction can result in a rebar mat that is deformed into a parallelogram shape, that has less effective reinforcing capacity, and that causes the misalignment of rebar ends for attaching to the next adjoining section of rebar mat. These problems have been exacerbated in recent years with the growing use of less viscous, quick drying concrete mixtures.

Since this is such a difficult problem, there have been a number of attempted solutions. One solution known to the inventor is a device described in U.S. Pat. No. 3,378,981 that includes a generally rectangular box-like support made of sheet metal that has first and second vertically extending walls with each wall including a recess to receive rebar. Tabs stamped into the metal shape can be bent over to hold the rebar in place. The difficulty with this device is that the rebar connector is metal, which by being in contact with the road bed, forms a path for corrosion to travel to the rebar mat and greatly accelerates the corrosion of the entire rebar mat.

Oxidation (formed by corrosion) of the rebar mat produces internal expansion forces that will cause the entire slab to crack and fail.

Consequently, these metal chairs are unacceptable for use in today's road construction. Moreover, the basic design of this generally rectangular box-like connector results in a space or pocket being formed by the intersection of three planes which will completely fill with concrete during concrete placement. This produces a void or hollow space in the concrete roadbed. This "voiding" problem has been exacerbated today because of the use of "stiffer" concretes, that are poured with a viscosity higher than in previous years. Consequently, the propensity for forming "voids" in the concrete prevent the use of these rectangular metal chairs in any publicly funded roadway and highway construction. In addition, because the chairs are constructed of metal they offer no resistance to racking forces. The metal chairs simply bend to accommodate to the deformed shape of a racked rebar mat.

The most popular rebar chair in use today is a plastic "tee-pee" shaped chair having a triangular shape, that is wider at the bottom and narrows to a point at the top where a U-shaped saddle acts as a receiver for rebar placed on top of the chair. Often the U-shaped saddle section is formed so as to snap around a portion of the rebar when it is lowered into the saddle section. The tee-pee chairs are made of various types of plastic, selected primarily upon manufacturing costs considerations. The design of this chair provides no means to prevent the chair from rotating off the rebar when lateral forces are applied to the mat, either before or during the concrete pour. Furthermore, these tee-pee shaped chairs offer no resistance to the racking forces applied to the rebar mat during the concrete pour.

Another similar type of rebar chair in commerce usage is referred to as the "square base chair." In function, it is identical to the "tee-pee" chair in that it is simply placed under the rebar mat, and snaps to a single section of bar. The larger base of this chair provides some additional strength, but offers no significant anti-rotation or anti-racking capabilities. Furthermore, both the "tee-pee" chair and the "square base chair" present significant voiding potential at the chair base at the intersection of the three vertical planes which form the support for the rebar mat.

Another type of chair used in some locations, referred as the "high-chair," has four round vertical plastic legs connect at the top with an "X" pattern to form a cradle for the rebar, and depending on the chair height, a second "X" between the legs in the lower part of the chair for strength. This rebar chair eliminates the voiding potential present in the "tee-pee and square base chairs; but again provides no anti-rotation or anti-racking forces. Furthermore, the "high-chair" must be tied to the mat itself adding an additional labor procedure to complete the mat.

The practice of tying the rebar intersections with wire somewhat mitigates against the transverse rebar sections from moving out of the designed location during the concrete pour, although this effect is not entirely eliminated. The wire tied joints, however, provide no support at the rebar intersections for resisting the forces that tend to deform the entire mat into a parallelogram. Thus, racking of the rebar mat remains a constant problem with today's less viscous concrete mixes used in roadway and other slab-type construction.

A primary concern for the contractor is that the current method of constructing rebar mats is extremely labor intensive. As discussed above, three separate steps are required to be performed by laborers on the location of the mat building. These steps include (1) laying out the rebar mat template, and tying it together with wire, (2) installing the chairs under the rebar mat template, in sufficient quantities to hold the mat off the roadbed, and (3) placing the remaining rebar sections on the template, after it is elevated off the roadbed, and making a second trip down the rebar mat to wire tie the rebar intersections together.

The present invention overcomes these problems by providing chairs that will not rotate off the rebar when lateral forces to the rebar mat are encountered. This anti-rotation feature results from the unique locking mechanism in the chair base and cap which uses the rebar mat itself to hold the chair in an upright position. Once the chair is locked on to the rebar mat at selected intersections, the rebar in the mat serves as a back-lock to prevent the cap from disengaging from the chair as rotational forces are applied. This feature of the present invention eliminates chair rotation. All other chairs use the chair base to retain the rebar support device in the vertical, upright, position. Consequently, all current chairs in use will rotate over when lateral forces are applied.

In addition, the inventive chairs eliminate wire tying the rebar mat template together, and permit the first and second steps of building and elevating the rebar template off the ground to be performed in a single step, which results in decreased labor costs. With the present invention, the rebar template sections are fastened together as the chairs are placed under the template to elevate the mat off the road bed. This feature eliminates over 50% of the required wire tie joints, and combines two steps of mat assembly into a single step.

The chairs of the present invention also provide substantial anti-racking support at the rebar intersections. After all the chairs are affixed to the rebar mat, they work together as a unit to prevent the mat from being deformed out of square.

The chairs and locking caps of the subject invention, when used as a system, virtually eliminate the possibility of mat failure during the concrete pour, either due to collapse of the mat to the road bed or from racking. The system of the subject invention also substantially lowers the amount of labor required to build the rebar mat by allowing the mat building process to be completed in a single trip down the mat.

The invention also incorporates an apparatus relating to the construction of multiple layer rebar mats that are in common usage in high traffic volume highways, particularly in urban areas. Current methods for building double and triple layer rebar mats involve simply building multiple mats on top of one another, using increasingly higher chairs for the upper level mats. This method retains all of the disadvantages of current rebar mat construction described above, and is further subjected to two additional and more serious problems. First, as the chairs become increasing higher in length, their propensity to rotate or tip over increases. Thus, the potential of upper layers of rebar mat falling onto the lower layers is always present, in spite of the use of expensive high rise chairs purportedly designed to mitigate against this problem.

Second, specifications for multiple layer mats require that the rebar sections be aligned along the same vertical planes. The only chair known to the inventors at this time which will allow the proper alignment of the upper layer mat, is a "spider-leg" chair, with four metal legs that allow it to be placed on top of the lower mat rebar intersection. Because this chair design requires that the chair be made of metal, a rust path to the upper rebar mats results, which is unacceptable for the same reasons described above regarding other metal chairs. When plastic chairs are used, they must be installed adjacent to the lower rebar sections, thus preventing the alignment of the upper mat bars with the lower mat bars. Thus, neither above described chair meets the accepted specifications for building multiple layer rebar mats.

The chair of the present invention, can include a special locking section which allows multiple rebar mats to be constructed on the same chair base. This assures the uniform separation of the multiple mats as designed by the project engineers and assures proper alignment of the bars in the lower and upper mats. Presently, there is no known rebar chair that allows for the use of a single chair to construct and lock multiple layer rebar mats together at the predetermined height.

The chairs of the present invention are also designed so as to virtually eliminate the phenomenon of concrete voiding, which is commonplace with all types of today's plastic chairs, with the exception of the "high-chairs". The chair legs of the present invention tapper to the road bed or their base, greatly reducing the size of the three plane intersections below the rebar mat. This results in minimal voiding potential. As discussed above, concrete voiding occurs at the intersection of the three planes that are designed into the base of all plastic chairs for vertical support. Because the chairs must be located beneath the rebar mat, the vibrators used in the concrete placement cannot exert direct forces on the concrete slurry below the mat. This results in air pockets forming in the chairs corners where the three planes (two vertical and one horizontal) intersect, creating voids in the base of the slab. Where voids are sufficiently numerous, the upward support force of the concrete is no longer uniform, which over time increases the likelihood of slab failure. Concrete cracking tends to run toward the voided areas.

The locking cap of the chairs of the present invention also provides another significant advantage in the economics of rebar mat construction for roadways and other slabs. The rebar mats of the present invention, once assembled, provide sufficient anti-racking force to the entire mat allowing the mats to be lifted and moved as a single unit. This allows for offsite construction of the mats and transportation to the job site as needed. This feature allows for substantial savings in the cost of rebar mat building and for faster completion of roadbed construction or other slab construction, resulting in as much as an 80% decrease in on-site time for laying the rebar mats. This offsite construction is particularly suited for tilt wall and retaining wall applications, where the rebar mats are small enough to allow transportation as a single unit.

Lastly, the inventive chairs are particularly well suited for use in tilt wall construction, where concrete slabs are poured on the ground over a rebar mat, and then tilted up into place. In tilt wall applications, the base of the chair will be visible on the underside of the wall after it has tilted upright. Because the current invention uses the rebar mat to hold it upright, rather than a large base, the support leg can be tapered to a point at the base, virtually eliminating any chair footprint after the tilt wall section has been tilted into the vertical position. Additionally, the chairs and locking caps of the present invention also include features that allow for the construction of rebar mats for vertical slabs and the construction of rebar mats on sloping surfaces.

SUMMARY OF THE INVENTION

This invention relates to an apparatus for fixating an interconnected rebar lattice having individual longitudinal and transverse rebar interconnections for use as support for poured concrete in roadway and other slab-type construction. The apparatus includes a holding portion having two open ended recesses, one on top of the other, with each having two opposing walls being generally U-shaped. One recess has a longitudinal axis and the second recess has a transverse axis with both being sized and shaped to receive a longitudinal rod and a transverse rod when placed onto the mat at the intersection of the rebar rods. Each of the opposing walls of the recesses include a locking means. A locking cap has locking means for attaching to the arc-shaped portions and engaging with the locking means of one of the open ended recesses and includes a generally arc-shaped portion. A leg portion extends downwardly from the holding portion and terminates in a base portion.

The inventive apparatus secures individual longitudinal and transverse rebar intersections of the rebar lattice in a locking relationship. The caps are snapped onto the holding portion, after the rebar is placed into the open ended recesses. The locking means in the holding portion deflect inwardly to allow the cap to move into the locked position, and then spring back over the cap's locking mechanism once the cap is in the locked position. This locking mechanism uses the steel bar within the holding portion to act as a back-lock, preventing the holding portion locking means from deflecting inward the apparatus encounters rotational forces. The configuration of the apparatus allows the upper rebar rods to be deflected upwardly when subject to rotational torque and thus, to move in behind the locking means of the holding portion to prevent inward deflection of the locking means, thereby preventing the detachment of the locking cap from the holding portion.

The subject invention also includes an apparatus for use with multiple layers of rebar mat. In this alternative embodiment, the locking member includes a leg portion on top of the locking member with the leg portion including a second U-shaped portion for holding the rebar of an upper mat on the same apparatus, with a locking member affixed to the top of the second holding portion for locking the entire apparatus into place upon the double rebar section.

The subject invention also includes a system for forming a rebar mat composed of an interconnected rebar lattice at a location other than the designated final location for the mat, and moving the fully assembled mat into place and joining the mat sections together with cam-snap locking couplers for connecting rebar mats together into a single unitized mat.

The subject invention further includes chairs and locking caps that allow for the construction of rebar mats for vertical slabs and tilt wall construction, as well as the construction of rebar mats on sloping surfaces.

DESCRIPTION OF THE DRAWING

The invention will become more apparent when the detailed description of exemplary embodiments is considered in conjunction with the appended drawings, in which.

DESCRIPTION OF THE PREFERRED EMBODIMENT

The present invention is a system for fixating an interconnected rebar latticework to form a rebar mat that is used as support for poured concrete in roadway and other slab-type construction. The rebar lattice is formed of individual longitudinal and transverse rebar rods which are interconnected at various individual intersections of the longitudinal and transverse rebar lattice structure in order to form a stable rebar mat that is used as support for poured concrete in the construction of roadways and other slab-type construction. One part of the system is a chair or apparatus 10 that is used to hold, secure and elevate an individual longitudinal and transverse rebar intersection that is formed by the rebar lattice structure.

Figure 5:
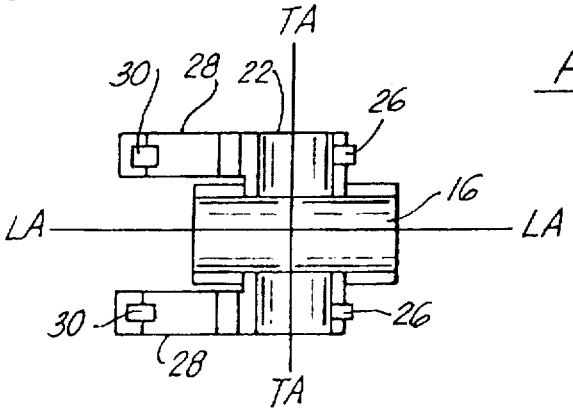
FIG. 5 is a top plan view of the embodiment illustrated in FIG. 1.
Figure 3:
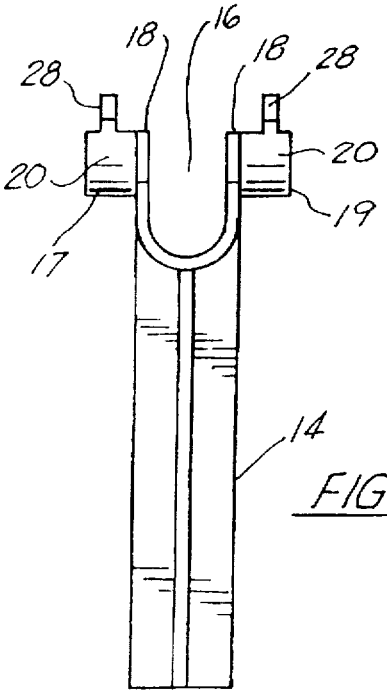
FIG. 3 is a back end plan view of the embodiment of FIG. 2.
Figure 4:
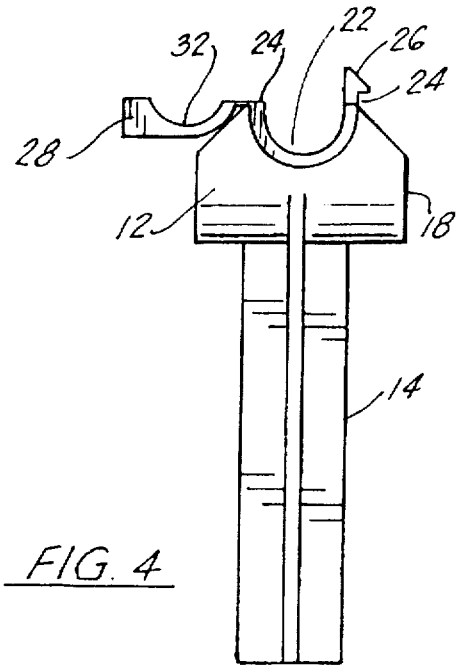
FIG. 4 is a side plan view of the embodiment illustrated in FIG. 1.

As shown in FIGS. 1–5, chair 10 includes a holding portion 12 and a leg portion 14. Holding portion 12 has an open ended recess 16 that is sized and shaped to receive a longitudinal rod (longitudinal rod not shown) such as the rebar that is used in roadway and slab-type construction. Holding portion 12 also includes two opposing walls 18 with the recess 16 and the opposing walls 18 forming a generally U-shape. Recess 16 includes a longitudinal axis LA, best illustrated in Figs.3 and 5. An arc-shaped portion 20 extends laterally and outwardly from each opposing wall 18 and is perpendicular to the longitudinal axis LA of recess 16, as illustrated in FIG. 3. Arc-shaped portions 20 have a transverse axis TA, as illustrated in FIG. 5, and are sized and shaped to receive a longitudinal rod (not shown) such as a rebar rod. Arc-shaped portions 20 have a recess 22 and opposing side walls 24 with one of the side walls 24 including a locking mechanism 26.

Leg portion 14 extends downwardly from the holding portion 12 and in a preferred embodiment is formed of two identical interconnected leg portions 34 with the two leg portions 34 having a generally X-shaped cross section. Preferably, leg portions 34 are each approximately ½ inch wide, ⅛ inch thick and the entire leg portion 14 is generally between about 3 to 8 inches long. The length of the leg portion 14 will depend upon the distance from the base upon which the chair 10 is to sit to the approximate middle portion or center of the slab in which the rebar lattice is to be placed. Preferably, the holding portion 12 and leg portion 15 are integrally formed of a plastic material such as polypropylene, a reinforced nylon-type material or polyethylene.

A locking cap or member 28 attaches to the arc-shaped portions 20 and includes a locking mechanism 30 for attaching the locking cap 28 to the arc-shaped portions 20. Locking member 28 also includes a generally arc-shaped portion 32 which is sized and shaped to receive a section of a rebar. The locking member 30 of the cap 28 engages and locks with the locking mechanism 26 of the arc-shaped portions 20. In one embodiment, the locking mechanisms 26, 30 are of a releasable snap-type lock, as is known by one skilled in the art of plastic snap-type locking mechanism, that can generally be locked by the force of hand pressure or without difficulty.

Figure 1:
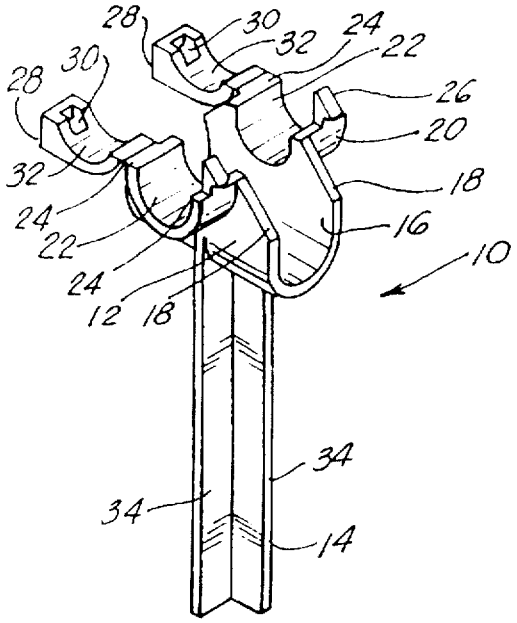
FIG. 1 is a perspective view of one of the embodiments of the present invention illustrating an unlocked position.
Figure 2:
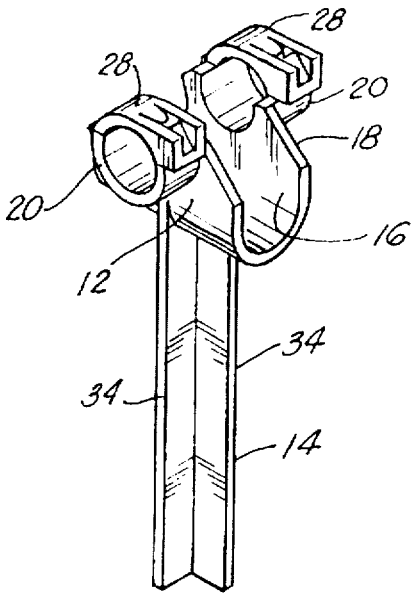
FIG. 2 is a perspective view of the embodiment of FIG. 1, illustrating a locked position.

In one embodiment, locking cap 28 is formed of two sections with each section being flexibly attached to one each of the opposing walls 24 of each of the arc-shaped portions 20. Each of the locking cap 28 sections can be generally rectangular in shape with each section including the arc-shaped portion 32, as best illustrated in FIG. 1. The flexible attachment of the cap sections 28 to the arc-shaped portions 20 can form a one piece hinge that is formed when certain types of plastic materials are used, known in the trade as a living hinge.

Figure 6:
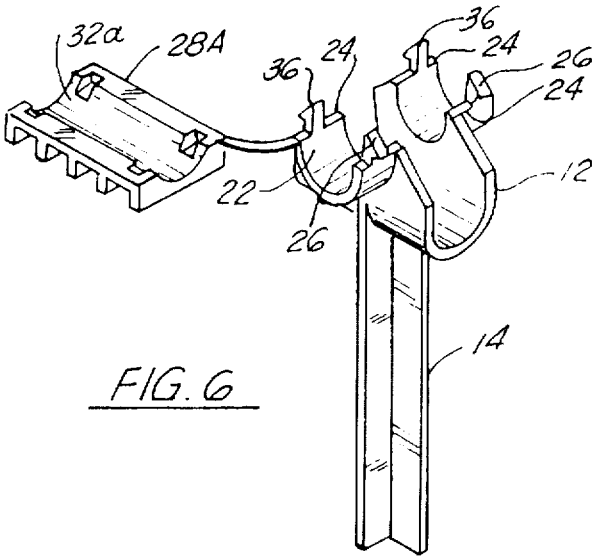
FIG. 6 is a perspective view of a second embodiment of the subject invention illustrating an unlocked position.
Figure 7:
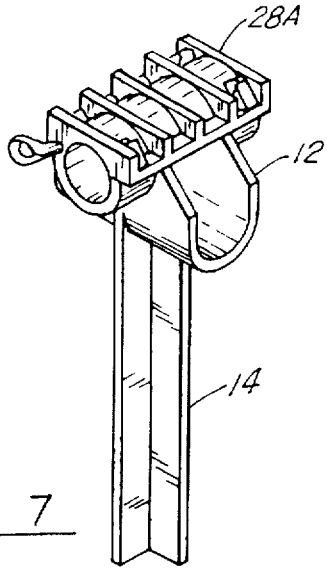
FIG. 7 is a perspective view of the embodiment of FIG. 6 illustrating a locked position.
Figure 8:
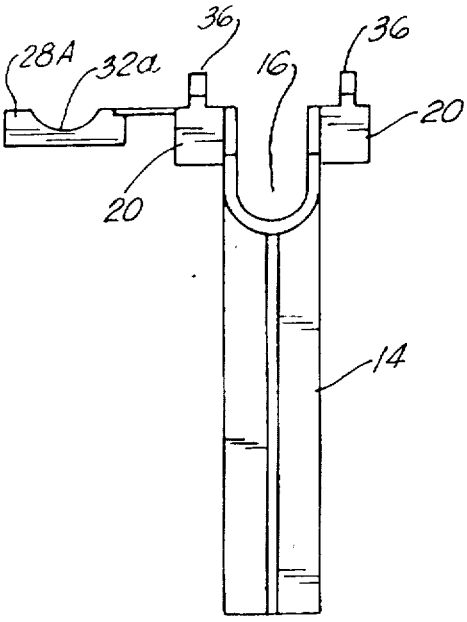
FIG. 8 is a back end plan view of the second embodiment illustrated in FIG. 6.
Figure 9:
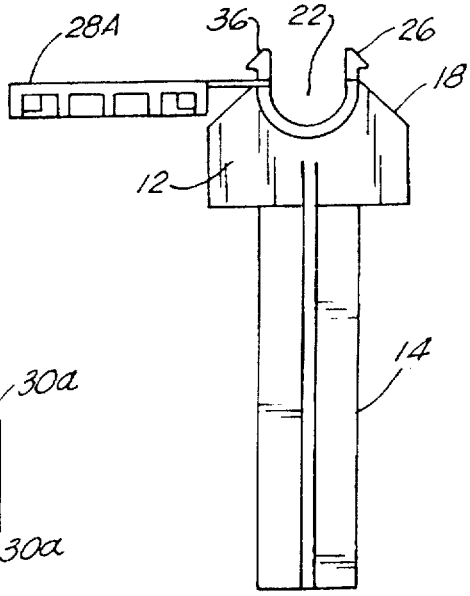
FIG. 9 is a side plan view of the second embodiment illustrated in FIG. 6.
Figure 10:
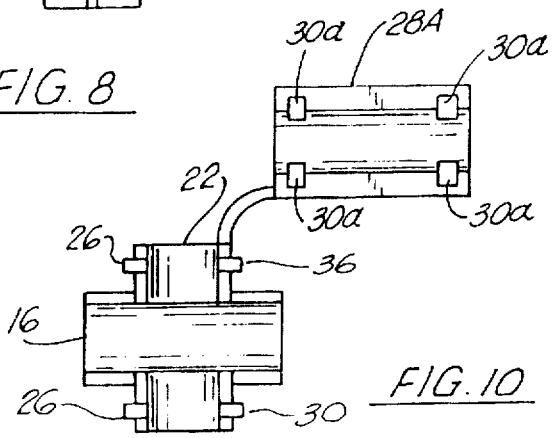
FIG. 10 is a top plan view of the second embodiment illustrated in FIG. 6.
Figure 11:
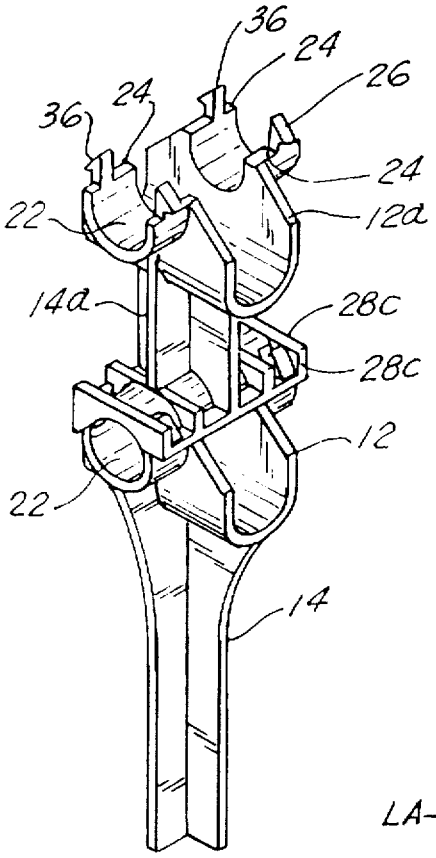
FIG. 11 is a perspective view of a third embodiment of the subject invention.
Figure 12:
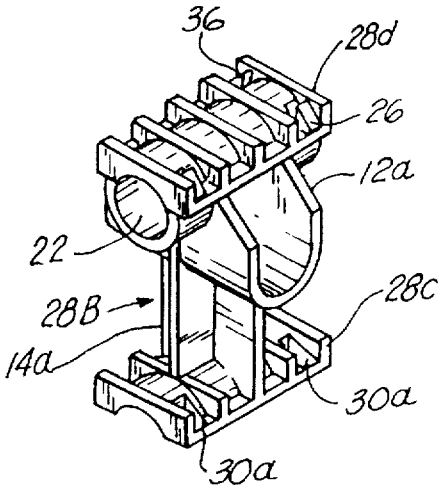
FIG. 12 is a perspective view of the alternate locking cap of the embodiment of FIG. 11.
Figure 15:
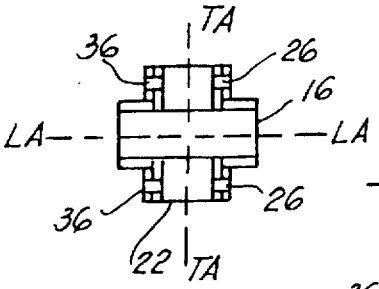
FIG. 15 is a top plan view of the third embodiment illustrated in FIG. 11.
Figure 14:
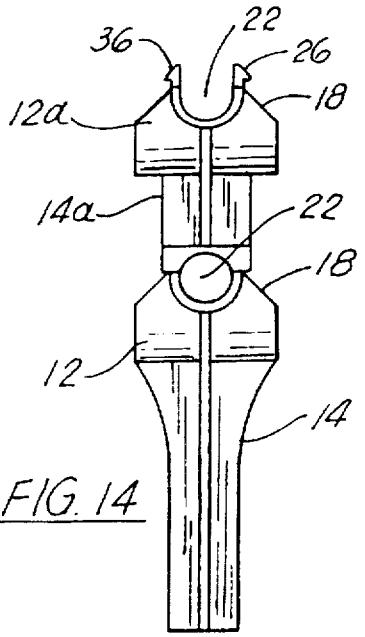
FIG. 14 is a side plan view of the third embodiment illustrated in FIG. 11.
Figure 13:
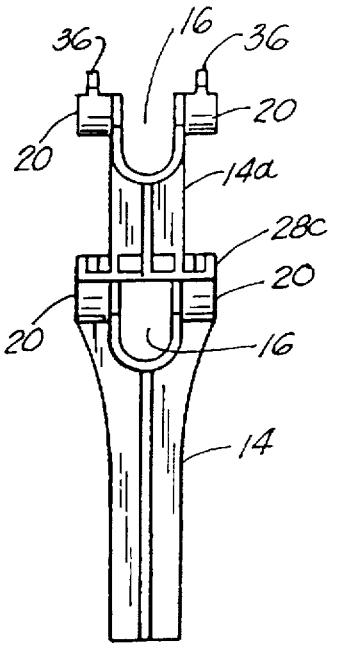
FIG. 13 is a back end plan view of the third embodiment illustrated in FIG. 11.

Alternatively, in applications where additional strength is desired, locking cap 28 can be formed of a single piece to form locking cap 28A, as illustrated in FIGS. 6–10. When the one piece locking cap 28A is used, holding member 12 includes a second locking mechanism 36 on one of each of the opposing walls 24 with the locking mechanism 36 being in alignment with the locking mechanisms 26 on the other opposing walls 24 of the arc portions 20. The one piece locking cap 28A is generally rectangular in shape and also includes an arc-like portion **32*a* which is placed along the entire length of the one-piece locking member 28A, as illustrated in FIG. 6. One piece locking cap 28A also includes at each of its four corners a locking mechanism 30*a* which engages with the locking mechanisms 26 and 36 on the arc-shaped portions 20. Locking mechanisms 26, 36 and 30*a* are of a non-releasable snap-type lock, known to one skilled in the art of plastic snap-type locks. In a preferred embodiment when the locking mechanisms 26, 36 and 30*a* are engaged, they form a non-releasable type lock which cannot be released once engaged. The locking mechanisms 26, 36 and 30***a* can be engaged by a force greater than the force available through hand pressure.

Figure 16:
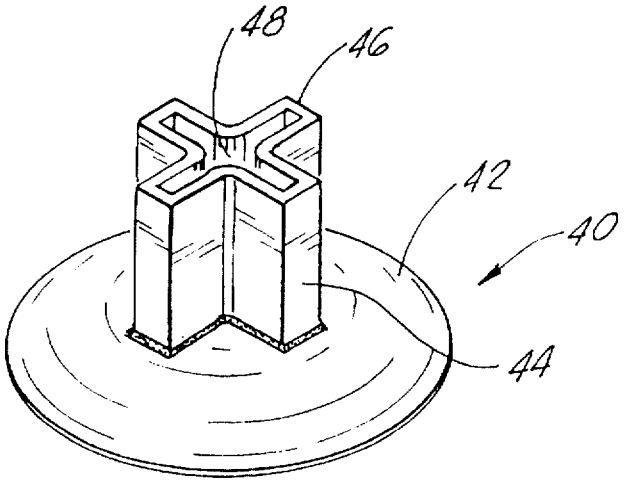
FIG. 16 is a perspective view of the stabilizing base of the present invention.
Figure 18:
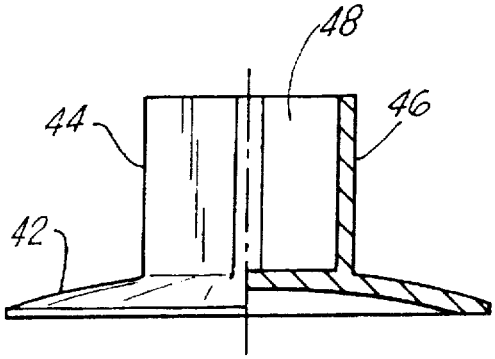
FIG. 18 is a partial cut-away view of the stabilizing base illustrated in FIG. 17 viewed across lines 18—18.
Figure 17:
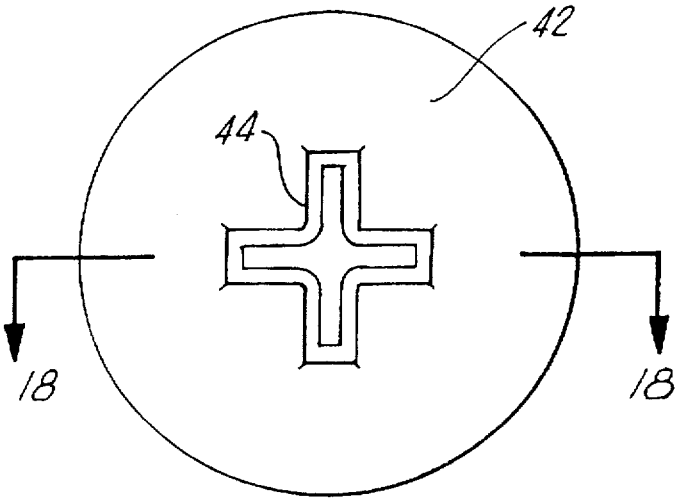
FIG. 17 is a top plan view of the stabilizing base illustrated in FIG. 11.
Figure 19:
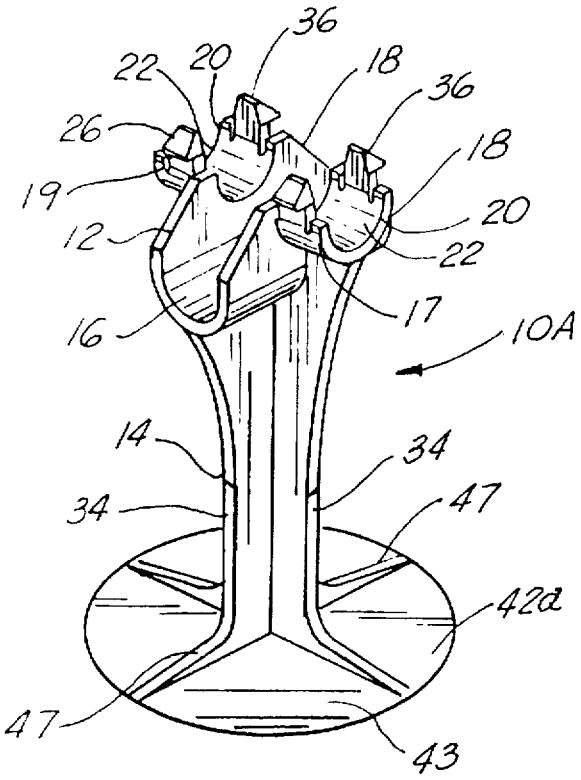
FIG. 19 is a perspective view of the preferred embodiment of the present invention illustrating an unlocked chair.
Figure 20:
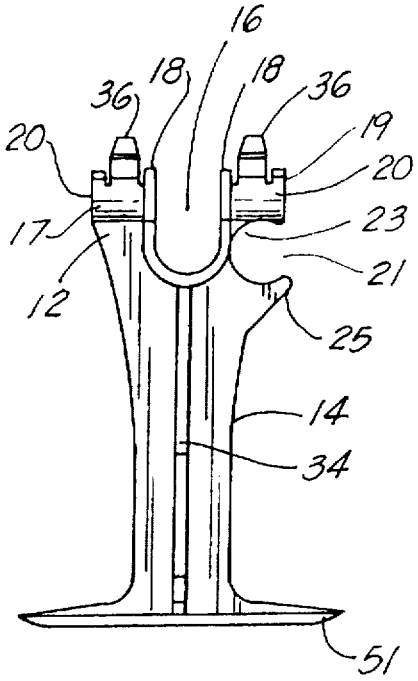
FIG. 20 is a back end plan view of the embodiment of FIG. 19.
Figure 21:
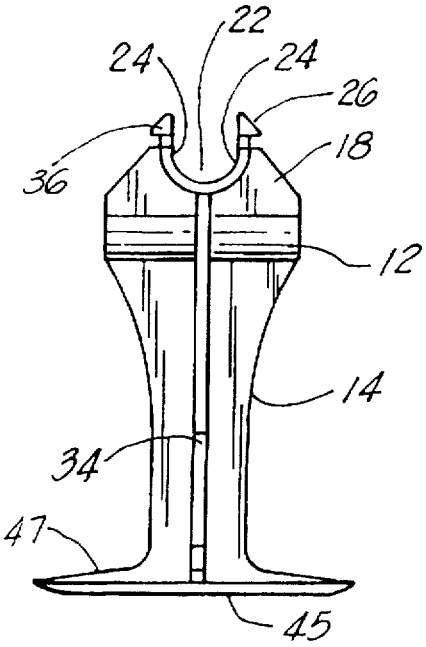
FIG. 21 is a side plan view of the embodiment illustrated in FIG. 19.

The system of the present invention also includes an apparatus for providing a base for the chair 10. As shown in FIGS. 16–18, a base 40 is used with chairs 10 when a rebar mat is being formed on unstable or soft bases, such as a dirt, sand or gravel road bed, a soft asphalt base due to heat or other unstable foundations, in order to prevent the chairs 10 from penetrating into the soft or unstable base of the road bed. The base 40 is not designed to hold the chair 10 in the upright position as this function is performed by locking the chair 10 to the rebar mat at the longitudinal and transverse rebar intersections. The base 40 has a generally circular base portion 42 and a centrally located holding portion 44 extending upwardly and perpendicular to the base portion 42. The holding portion 44 includes outer walls 46 and an opening 48 which is sized and shaped to accommodate and engage the leg portion 14 of the chair 10. In a preferred embodiment, the circular base has a radius of generally between 2 and 4 inches and the holding portion 44 is generally between about ¼ to ¾ inches high. Preferably, the base 40 is formed from a plastic such as polypropylene, a reinforced nylon material or polyethylene.

The chair 10 and locking cap 28 is configured to secure a plurality of individual longitudinal and transverse rebar intersections to form a rebar lattice structure used as a support for poured concrete in roadway and other slab-type construction in which the structure of the rebar lattice holds the chair 10 and locking cap 28 in an upright position.

Another preferred embodiment of the present invention is a chair 10A (FIGS. 19–22) which includes a holding portion 12 and a leg portion 14. Holding portion 12 has an open ended recess 16 that is sized and shaped to receive a longitudinal rod (longitudinal rod not shown) such as the rebar that is used in roadway and slab-type construction. Holding portion 12 also includes two opposing walls 18 that with recess 16 form a generally U-shape. Recess 16 includes a longitudinal axis LA best illustrated in FIGS. 3 and 5.

A arc-shaped portion 20 extends laterally and outwardly from each opposing wall 18 and is perpendicular to the longitudinal axis LA of recess 16 as illustrated in FIG. 3. Arc-shaped portion 20 includes a first side 17 and a second side 19, and a transverse axis TA, as illustrated in FIG. 5. Arc-shaped portions 20 are sized and shaped to receive a longitudinal rod (not shown) such as a rebar rod. Arc-shaped portions 20 each have a recess 22 and opposing side walls 24 with one of the side walls 24 including a first locking mechanism 26 and the other side walls 24 including a second locking mechanism 36. Locking mechanisms 26 and 36 are in parallel alignment with each other on the opposing walls 24 of the arc portions 20. In a preferred embodiment, locking mechanisms 26 and 36 are leg shaped members with a barbed-shaped end portion, best illustrated in FIGS. 19 and 21.

Figure 22:
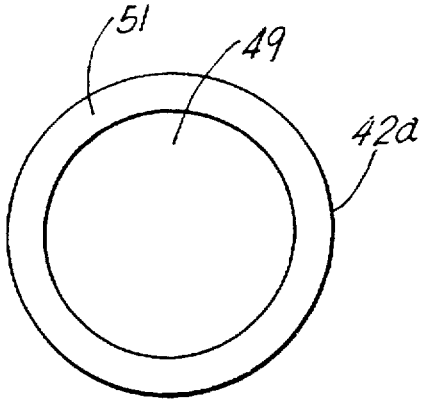
FIG. 22 is a bottom plan view of the embodiment illustrated in FIG. 19.

Leg portion 14 extends downwardly from holding portion 12 and in a preferred embodiment, is formed of two identical interconnected leg portions 34 with the two leg portions 34 having a generally X-shaped cross-section. Leg portions 34 extend into and are integrally formed with a base portion 42*a*. Base portion 42*a* includes an upper surface 43 and a lower surface 45. Leg portions 34 extend into tapering rib portions 47 on the upper surface 43 of base portion 42*a* and provide strength and stabilization to base portion 42*a*. Bottom surface 45 of base portion 42*a* includes a generally flat center portion 49 and a slightly upwardly slanting rim portion 51 (FIG. 22). The base portion 42*a* is generally circular in shaped and has a radius of generally between 2" and 4". Base 42*a* prevents the chairs 10A from penetrating into soft or unstable bases of a road bed or other foundation. The upwardly slanting rim portion 51 prevents the base portion 42*a* from rocking on the unstable or soft foundation or road bed.

Figure 23:
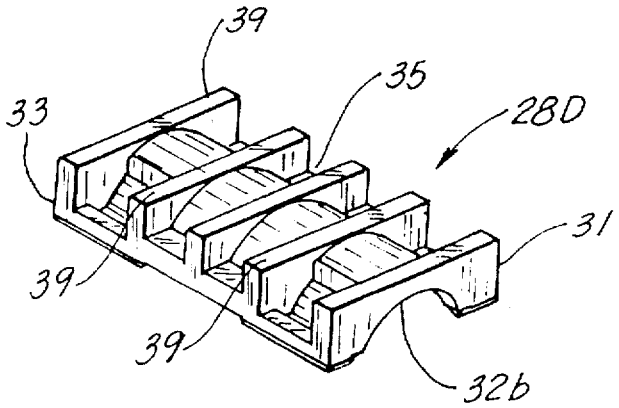
FIG. 23 is a perspective view of an alternate locking cap of the subject invention.
Figure 24:
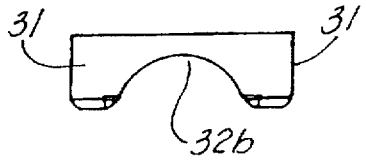
FIG. 24 is a end plan view of the locking cap of FIG. 23.
Figure 25:
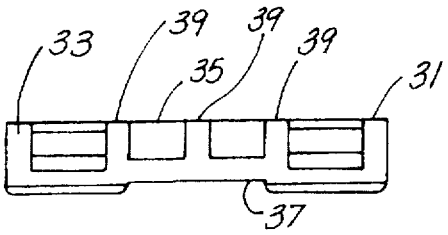
FIG. 25 is a side plan view of the locking cap of FIG. 23.
Figure 26:
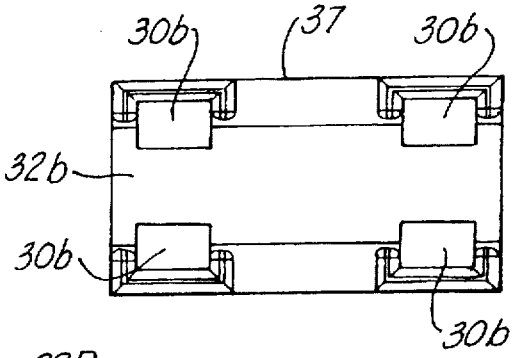
FIG. 26 is a bottom plan view of the locking cap of FIG. 23.

A preferred embodiment of the one piece locking cap 28 is locking cap 28D (FIGS. 23–26). Locking cap 28D is generally rectangular in shape and includes an arc-like portion 32*b* placed along the entire length of the one piece locking member 28D, as illustrated in FIG. 26. Locking cap 28D also includes a first end portion 31, a second end portion 33, a top 35, and a bottom 37. A plurality of reenforcing ribs 39 are placed laterally along the top 35 of locking cap 38D, reenforcing the arc-like portions 32*b* (FIG. 23). Locking cap 28D includes at each of its four comers a locking mechanism 30*b* which engages with locking mechanisms 26 and 36 on the arc-shaped portions 20. In a preferred embodiment, locking mechanisms 30*b* are formed of four rectangularly shaped openings with reenforced edges as illustrated in FIG. 26. Locking mechanisms 26, 36 and 30*b* are of a non-releasable snap-type lock, known to one skilled in the art of plastic snap-like locks.

Figure 27:
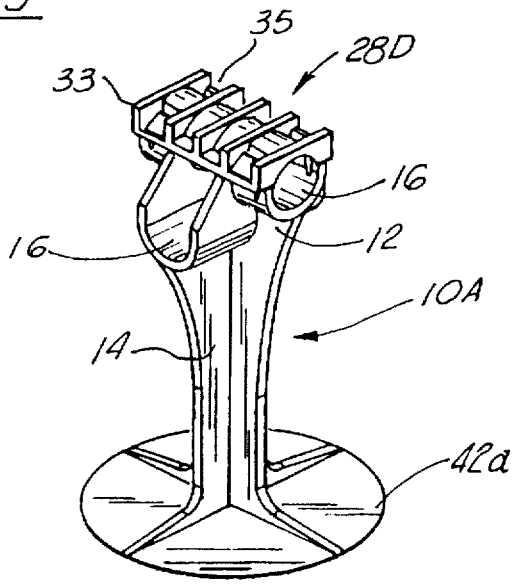
FIG. 27 is a perspective embodiment of the assembled chair of FIG. 19 and locking cap of FIG. 23.
Figure 28:
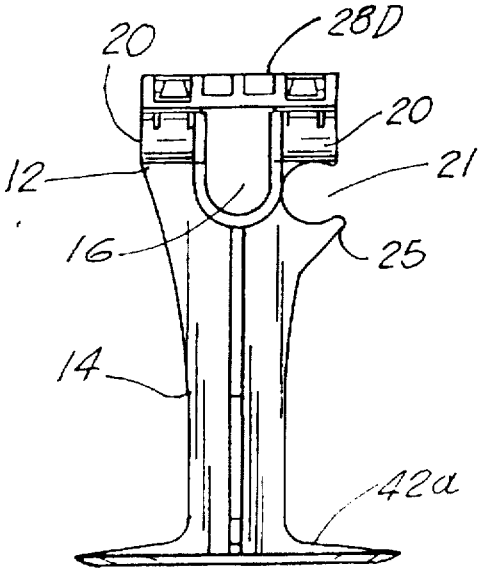
FIG. 28 is a back plan view of the assembled embodiment of FIG. 27.
Figure 29:
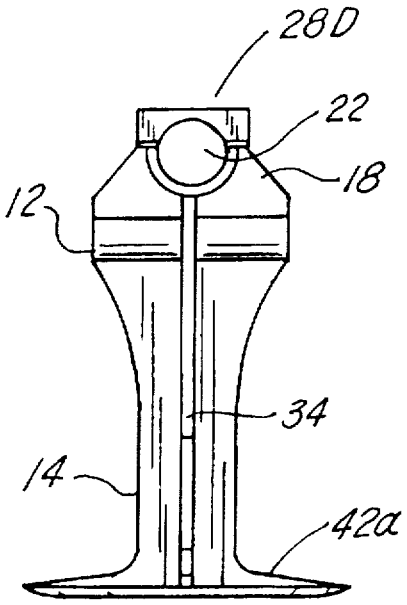
FIG. 29 is a side plan view of the assembled embodiment of FIG. 27.

Chair 10A is assembled with locking cap 28D (FIGS. 27–29) to form a apparatus for fastening together individual rebar members in order to build a unitized rebar mat section. The rebar mat section is formed by placing the rebar in the open recess 16 of chair 10A and a second rebar is placed in the recess 22 of arc-shaped portions 20. After the rebar is placed in open recess 16 and arc-shaped portions 20, and the locking cap 28D is snapped into the locked position, locking members 26 and 36 deflect inwardly, toward the center of the rebar. Locking mechanisms 26 and 36 and the open recess 16 are sized so that when the rebar is in the open recesses 16 and 22, locking mechanisms 26, 36 have sufficient room to deflect inward in order to allow the locking cap 28D to be snapped into a locked position.

In a preferred embodiment, open recess 16 should be sized to the maximum size of tolerance allowed for any specific rebar size. In this manner, when chairs 10A in the rebar mat are subject to rotational torque, the rebar will move up against the bottom 37 of locking cap 28D of chair 26A and into a position that will prevent the locking mechanisms 26, 36 from deflecting sufficiently inward to become detached or unlocked from the chair 10A. By utilizing the rebar as a back-lock for the deflecting locking mechanisms 26, 36, the chair 10A, once attached to the mat, will not rotate off the rebar mat. This is an improvement that is not found in existing rebar support devices which allow the chairs to become detached from the rebar when rotating torque is encountered. It is this characteristic of the existing rebar support devices which causes mat failure prior to the concrete pour. The locking mechanism of chair 10A and locking cap 28D eliminates this cause of rebar support failure. Another design feature of the chair 10A and locking cap 28D, is the ability of the assembled unit (chairs, locking cap and rebar lattice) to utilize the rebar mat to hold chairs 10A in an upright position rather than have the chairs 10A hold up the rebar mat as is found in existing rebar support devices.

Another component of the chair 10A is a snapping notch 21 (FIG. 20) that is molded into the side of chair 10A. Notch 21 is placed directly below the second side 19 of arc-shaped portion 20. Notch 21 includes a semi-circular recess 23 that ends in a lip portion 25 that creates the shape of notch 21, allowing it to be a "snapping" notch. Cylindrical coupler bar devices (not shown) can be snapped into notch 21 of adjoining chairs 10A during installation of the rebar mat to hold adjoining rebar mats together prior to a concrete pour.

When multiple lanes of highways or roadways are poured, the roads are assembled and poured in single to two lane wide sections at a time. The adjoining rebar mat sections are connected together prior to the concrete pour. Coupler bars are customarily installed at the outside of the rebar mat sections in order to join the sections together. The coupler bars contain a threaded coupler into which a second coupler bar can be attached to tie onto the adjoining lane. Currently, these coupler bars are held or tied to each rebar support device and then simply tied onto each adjoining transverse bar. Notch 21 on rebar chair 10A can simplify this process by positioning notch 21 parallel to the transverse rebar so that the coupler bar can be snapped into the notch 21. In this manner, the coupler bar is automatically installed in the proper location when building the rebar mat for each lane or section of roadway. Thus, the construction worker is required only to tie the coupler onto the transverse rebar prior to connecting the couplers together in preparation for the concrete pour.

Figure 30:
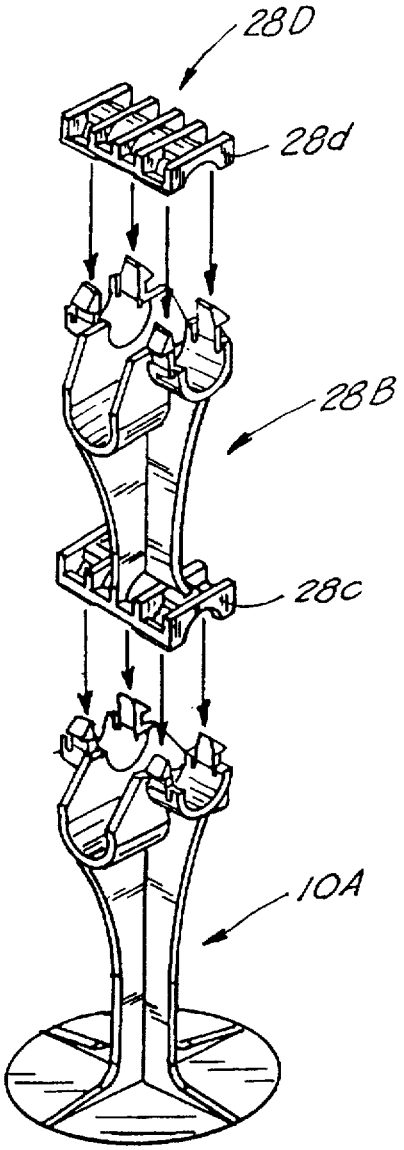
FIG. 30 is a perspective view of the embodiment of FIG. 19 assembled with the locking cap of FIG. 12 and the locking cap of FIG. 23.

Another embodiment of the double mat locking cap 28B (FIGS. 11–15) is illustrated in FIG. 30. The double mat locking cap 28B as described above, is used when it is desirable to form a double rebar mat for support of thicker slabs used in road ways having high traffic volume and vehicles with heavy loads. An improved locking cap 28B includes a base locking cap 28*c*, a holding portion 12*a*, a leg portion 14*a* and a top locking cap 28D. Base locking cap 28*c* is identical in structure to locking cap 28D except that a shortened chair 10 is attached to the top of base locking cap 28*c*. The shortened leg portion 14*a* is identical to leg portion 14, but in a preferred embodiment is generally 2 to 3 inches in height. Holding portion 12*a* is identical to the holding portion 12 of chair 10 and includes the locking mechanisms 26 and 36 as illustrated in FIG. 6. Top locking cap 28D is identical in structure to the locking cap 28D and provides the same locking function as locking cap 28D. FIG. 30 illustrates the assembly of a chair to be used to form a double mat.

The double mat locking cap 28B can be used with any of the embodiments of chair 10 and in the same manner as other locking caps 28 and 28A when a double rebar mat is being formed. In constructing a double mat, a first set of longitudinal and transverse rebar rods are put in place in, for example chair 10A, base locking cap 28*c* is locked in place and a second set of longitudinal and transverse rebar rods are placed in the holding portion 12*a* and the top locking cap 28D is locked in place. In a preferred embodiment, the locking caps 28, 28A, 28B and 28D are formed of a plastic material such as polypropylene or a reinforced nylon-type material. A third leg portion and holding portion could also be attached above locking cap 28D if a triple rebar mat is desired.

When chair 10 is assembled with any of the embodiments of the locking caps, such as for example locking caps 28, one piece locking cap 28A, 28D, or the double mat locking cap 28B, the arc-shaped portions of each cap form a generally circular opening which engages and holds an individual transverse rebar in a locking connection with the longitudinal rebar placed below it.

Figure 31:
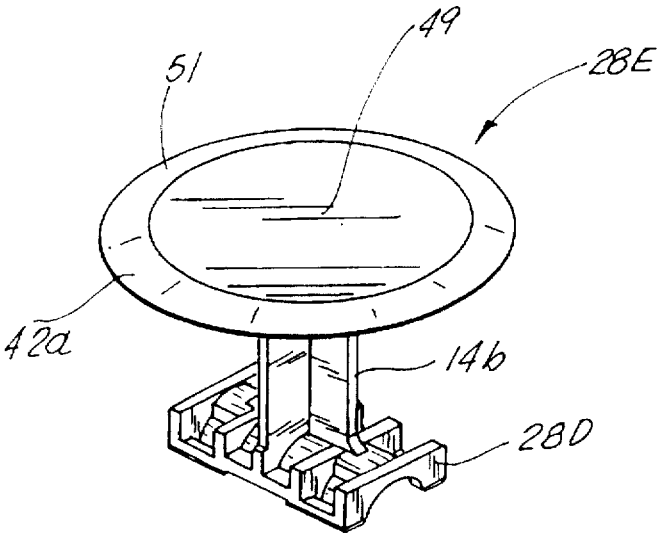
FIG. 31 is a perspective view of an alternate locking cap of the subject invention.
Figure 32:
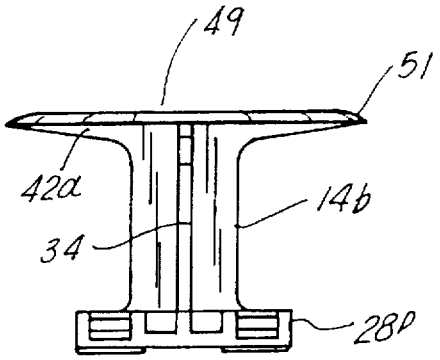
FIG. 32 is a side plan view of the locking cap of FIG. 31.
Figure 33:
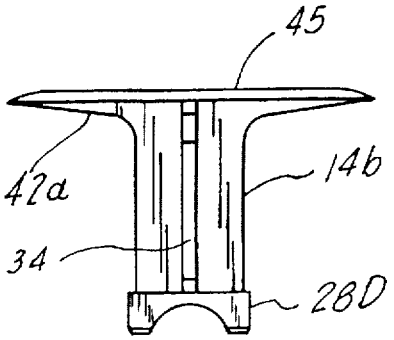
FIG. 33 is a end plan view of the locking cap of FIG. 31.
Figure 35:
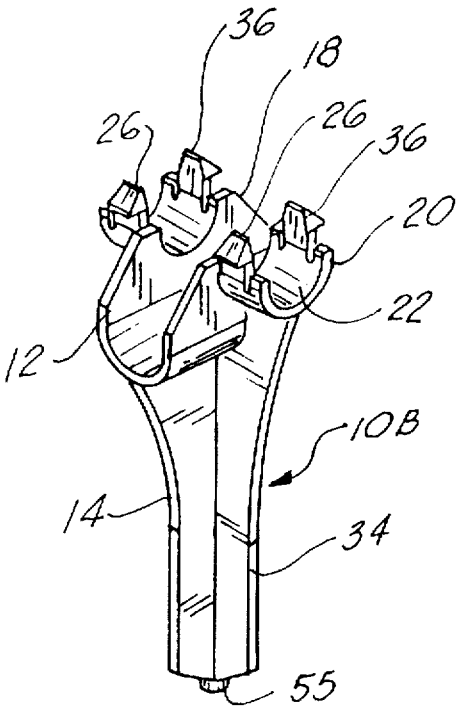
FIG. 35 is a perspective view of an alternate embodiment of the subject invention
Figure 38:
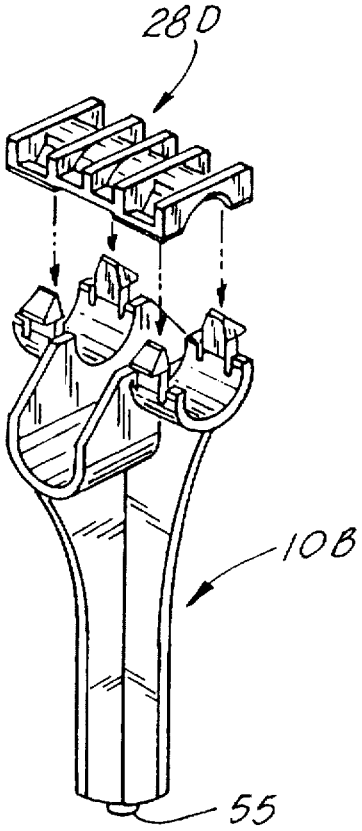
FIG. 38 is a perspective view of the embodiment of FIG. 35 assembled with the locking cap of FIG. 32.
Figure 36:
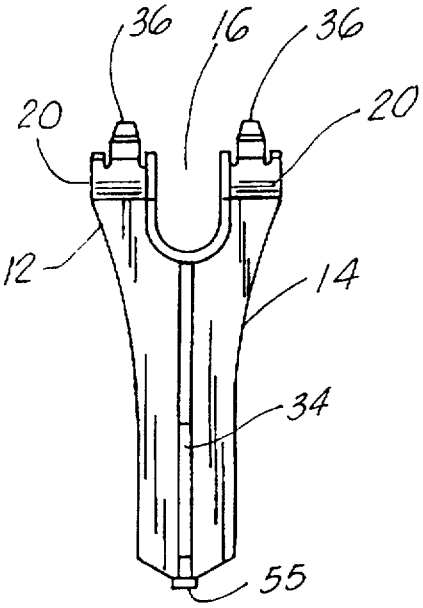
FIG. 36 is a back plan view of the embodiment of FIG. 35.
Figure 37:
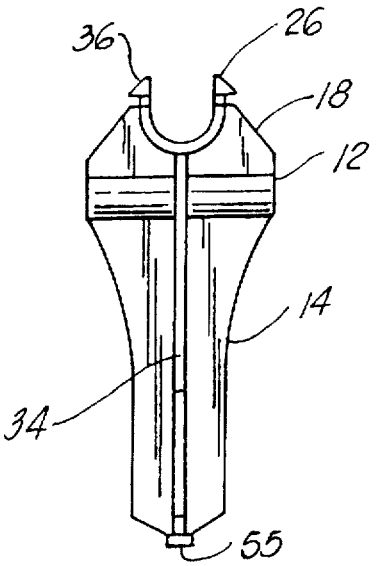
FIG. 37 is a side plan view of the embodiment of FIG. 35.
Figure 39:
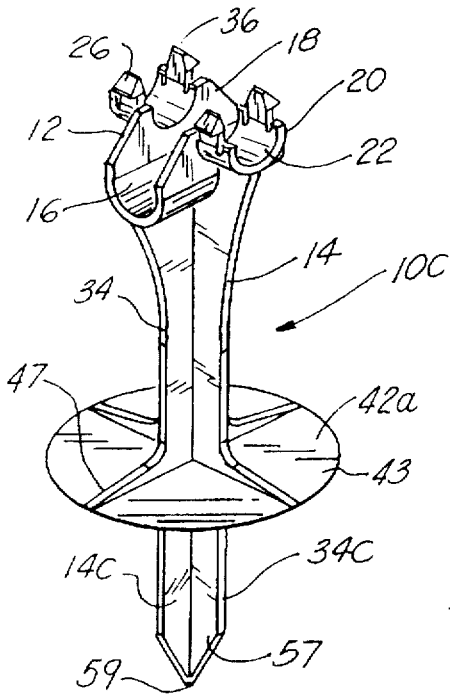
FIG. 39 is a perspective view of another embodiment of the subject invention.
Figure 42:
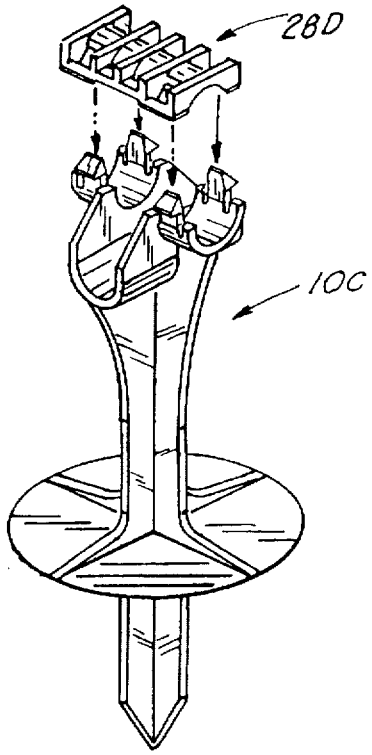
FIG. 42 is a perspective view of the embodiment of FIG. 39 assembled with the locking cap of FIG. 32.
Figure 40:
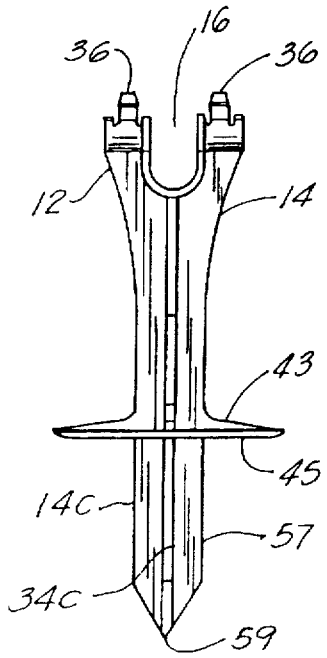
FIG. 40 is a back plan view of the embodiment of FIG. 39.
Figure 41:
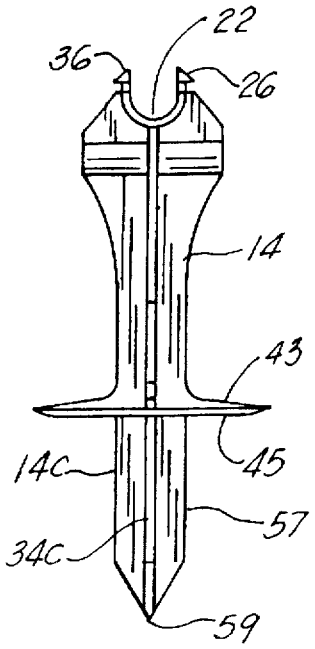
FIG. 41 is a side plan view of the embodiment of FIG. 39.

An alternate locking cap 28E (FIGS. 31–34) is for use in constructing vertical rebar mats. The use of locking cap 28E insures that the rebar mats remain in their desired location between the two vertical wall forms that hold the rebar mat in position prior to the pouring of the concrete. Locking cap 28E is formed from locking cap 28D to which an upwardly extending leg portion 14*b* and an inverted base portion 42*a* has been integrally attached. Leg portion 14*b* is of substantially the same construction as leg portion 14 and base portion 42*a* is identical to base portion 42*a* of chair 10A. Thus, locking cap 28E provides a chair 10A having a holding portion 12 positioned between two outwardly extending base portions 42*a*. As illustrated in FIGS. 31–33, leg portion 14*b* and base portion 42*a* include all of the features of leg portion 14 and base portion 42*a* present in locking chair 10A and described above. Locking chair 28E is integrally formed of a plastic material such as polypropylene, a reinforced nylon-type material or polyethylene.

Figure 34:
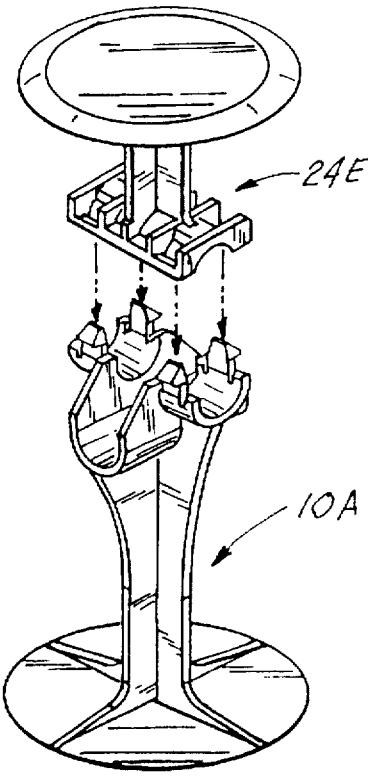
FIG. 34 is a perspective view of the chair of FIG. 19 assembled with the locking cap of FIG. 31.

When a vertical rebar mat is built between two forms, one base portion 42*a* rests against the interior form and the second base portion 42*a* rests against the exterior form utilized when vertical concrete walls are poured in an upright position. As illustrated in FIG. 34, when the chair 10A is assembled with locking cap 28E, the assembly provides a rebar support device that will hold the longitudinal and transverse rebar sections in place between the two forms prior to the concrete pour. This design not only facilitates the building of a rebar mat in a vertical position, but it also insures that the rebar mat will remain in the appropriate location between the forms after it is assembled, rather than deflecting inwardly or outwardly under gravitational forces before the concrete pour or deflecting when the forces of the concrete pour meet the steel rebar.

Another alternate chair 10B, for use in tilt wall construction, is illustrated in FIGS. 35–38. Chair 10B includes all of the elements of chair 10A except base portion 42*a*. Instead, chair 10B has a base portion 55 that tapers to a small knob shape. Knob base 55 is placed at the end of legs 34 and has a diameter that is smaller than a diameter of the leg portion 14. Knob base 55 can be of any shape, but preferably is square or cylindrical in shape. Knob base 55 is integral with chair 10B.

As with other embodiments of chair 10, when longitudinal and transverse rebars have been placed in the recess 16 and arc-shaped portion 20 of chair 10B, the locking cap 28D is locked into place over the rebar sections. Once the mat is assembled, the rebar mat holds the chairs 10B upright. By utilizing the rebar mat to hold the chairs 10B in an upright position, no wide horizontal base or multi-leg design is required. It is preferable to use chair 10B in tilt wall construction because the knob base 55 results in a minimum or negligent foot print on the exterior of the tilt wall after the tilt wall has cured and is tilted into the upright position.

Another advantage of the assembly of chair 10B and locking cap 28D (FIG. 38) is that it allows rebar mats for tilt wall construction to be assembled outside of the typical tilt wall form. The tilt wall rebar mats can be assembled on the constructions site and then moved by lifting devices from the assembly site to the concrete forms that are placed adjacent to the slab where the wall will ultimately be tilted into place. Under current tilt wall construction methods, the rebar mat is constructed inside of forms built to the desired size of the wall unit. The concrete is then poured into the forms. The surface onto which the concrete is poured is treated with various non-stick coatings, so that after the concrete for the tilt wall has cured, it can be tilted up from the horizontal position without adhering to the underlying surface.

With current methods of building rebar mats, the non-stick coatings on the undersurface are damaged during the construction of the rebar mat by workers walking on the coatings during the mat building process. This requires a second treatment of the underlying surface after the mat has been built, before the concrete can be placed into the form. By using the assembled device of chair 10B and locking cap 28D, the assembly of the rebar mat can take place outside of the forms, and once the locking caps 28D are locked into place, the entire rebar mat can then be picked up as a single unitized unit, with a lifting device and placed inside the form. This eliminates the need for workers to work inside the forms after the underlying surface has been treated with a non-stick coating. This method also allows for increased efficiency in the building of the rebar mats by utilizing the rebar mat jigs described below and illustrated in FIGS. 43–46.

Another alternate embodiment of the present invention is chair 10C which is identical to chair 10A except it includes a spike portion 57 extending downwardly from the lower surface 45 of base 42*a* (FIGS. 39–42). Spike portion 57 includes a leg portion 14*c* that tapers to a point 59. Leg portion 14*c* is formed of two identical interconnected leg portions 34*c* with the two leg portions 34*c* having a generally X-shaped cross-section. Preferably, leg portions 34*c* are each approximately ½ inch wide, ⅛ inch thick with the length of leg portion 14*c* being dependent upon the distance from the base 42*a*, spike 57 needs to extend. Preferably, the chair 10C is integrally formed of a plastic material such as polypropylene, a reenforced nylon-type material or polyethylene.

Figure 43:
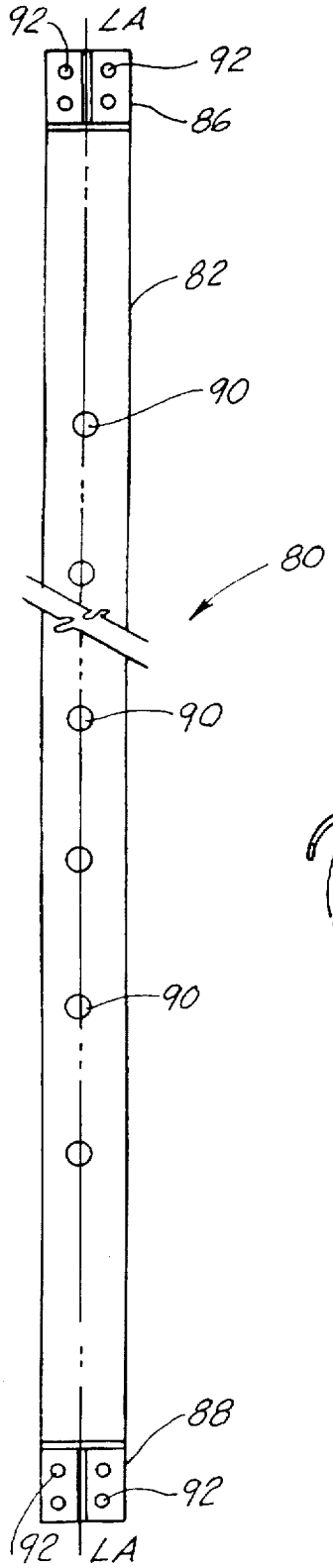
FIG. 43 is a top plan view of a template of the subject invention.
Figure 44:
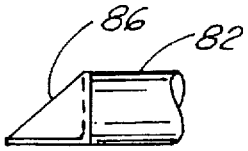
FIG. 44 is a side plan view of a portion of the longitudinal member illustrated in FIG. 43.

The assembled chair 10C and locking cap 28D, as shown in FIG. 43, is used in the construction of side walls for pools or other utility-type construction in which the concrete walls are placed on a sloping or vertical surface. The spikes 57 of chair 10C allow the chair to be secured in dirt in order to hold the rebar in place during construction of the rebar mat. Chairs 10C can be used on any sloping surface in which greater chair stability and non-sliding chairs would be desirable.

All of the embodiments of chair 10 and locking cap 28 described above are configured to secure a plurality of individual longitudinal and transverse rebar intersections to form a rebar lattice structure used as a support for poured concrete in roadway and other slab-type construction in which the structure of the rebar lattice holds the chair 10 and locking cap 28 in an upright position.

The system of the subject invention also includes a template 80, as illustrated in FIGS. 43–46. Template 80 has two longitudinal members 82 and a plurality of transverse members 84 that are used to form a rebar mat composed of interconnected rebar lattice having individual longitudinal and transverse rebar intersections. Each longitudinal member 82 is at least sixty (60) feet in length and includes a first end 86 a second end 88. Longitudinal member 82 has a longitudinal axis LA and a plurality of evenly spaced openings 90 placed along the longitudinal axis LA of the longitudinal member 82 (FIG. 43). Preferably, the openings 90 are spaced generally six (6) feet apart. In a preferred embodiment, first and second ends 86, 88 (FIG. 44) of the longitudinal member 82 are cut or slanted at a generally 90° and include a plurality of openings 92 for securing the longitudinal members 82 to a supporting structure during the formation of the rebar mat. Spikes or any other securing mechanisms can be used to secure the first and second ends 86, 88 of the longitudinal members 82 to a support structure such as the ground or a wooden platform. In a preferred embodiment, the longitudinal members 82 are formed of aluminum pipe that is cylindrical in shape.

Figure 46:
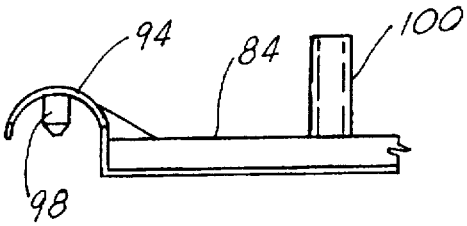
FIG. 46 is a side plan view of a portion of the transverse member illustrated in FIG. 45.
Figure 45:
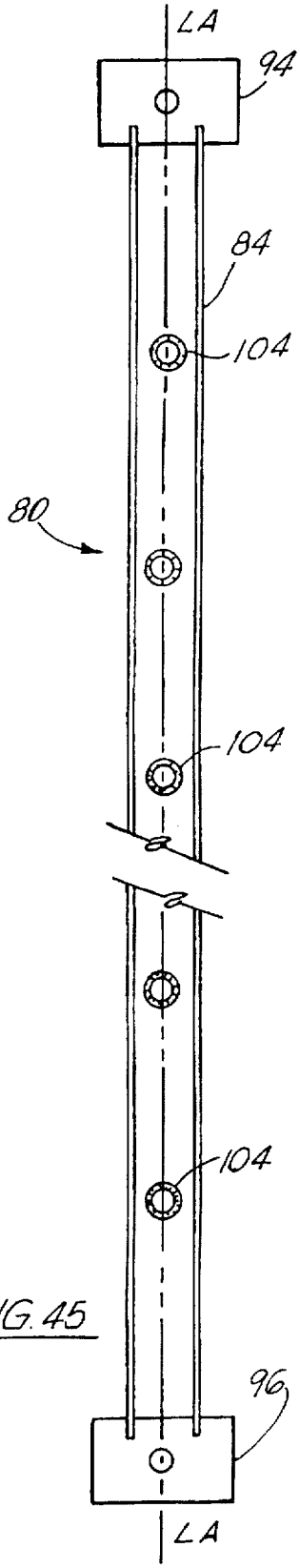
FIG. 45 is a top plan view of a transverse member of a template of the present invention.

The plurality of transverse members 84 (FIG. 45) has a first end portion 94 and a second end portion 96 that are sized and shaped to engage with the openings 90 of the longitudinal members 82 (FIG. 46). In a preferred embodiment, the end portions 94, 96 are arcuate in shape in order to conform to the cylindrical shape of longitudinal members 82. Each of the arcuate-shaped end portions 94, 96 include a projection 98 on the end portions' 94, 96 under side that is sized and shaped to engage one of the plurality of openings 90 placed along the longitudinal members 82. In a preferred embodiment, the plurality of transverse member 84 are formed of steel channel.

Each transverse member 84 includes a plurality of holders 100 (FIG. 46) evenly spaced along the longitudinal axis LA of the transverse member 84, preferably, spaced at generally nine (9) foot intervals. Holders 100 extend upwardly and perpendicular to the longitudinal axis LA of each transverse member 84 with each holder 100 being sized and shaped to accommodate and hold the leg portion 14 of each of the chairs 10. In a preferred embodiment, the holders 100 are formed of steel pipe and each holder 100 is generally about nine (9) inches in height. Each of the transverse members is generally about 12 and ½ feet in length.

The template 80 is formed by placing the two longitudinal members 82 a spaced apart distance from each other and securing the ends 86, 88 of each of the longitudinal members 82 to a supporting structure or the ground. The plurality of transverse members 84 are placed transversely over each of the two longitudinal members 82, with each of the first and second end portions 94, 96 of the transverse members 84 being placed in an opening 90 of each of the two longitudinal members 82. The plurality of transverse members 84 are placed in parallel alignment along the longitudinal members 82. After the template 80 has been assembled, any embodiment of chairs 10 are placed in each of the holders 100 and the rebar rods are placed both longitudinally and transversely across the template 80 with the appropriate chairs holding selected individual intersections of the longitudinal and transverse rebar rods. When the entire mat is assembled, locking cap 28D, or any other of the locking cap embodiments, locks the rebar in place, securing the rebar lattice into one connected rebar mat which can be moved from the template 80 and transported for placement upon the road bed or other form at the desired location. If a double rebar mat is constructed, the same process is used, except the double mat locking caps 28B are used.

With the use of the system of the present invention, the rebar mats may be assembled directly on the road bed or other slab-type foundation in which the chairs 10–10C with the locking caps 28–28E can be used. Alternatively, the template 80 may be used to form a rebar mat which preferably the chairs 10B with the locking caps 28D are used. In this situation, the rebar mat is formed on the template 80 and then moved into position on the road bed.

These and other features of this invention are included within the scope of this disclosure, which is intended to cover various modifications of the techniques, procedures, methods, materials and equipment as will be apparent to those in the art. It is intended that all such variations within the scope and spirit of this disclosure be embraced.

What is claimed is:

1. An apparatus for fixating and elevating mats of an interconnected rebar lattice having intersections of longitudinal and transverse rebar rods for support of poured concrete, comprising:

a) a base member comprising:

1) a holding portion having a plurality of base member locking mechanisms and having recesses to receive individual longitudinal and transverse rods of a rebar intersection of the rebar lattice; and 2)a leg portion extending from the holding portion for spacing of the holding portion above a surface to receive the concrete;

b) a locking cap for engaging the holding portion locking mechanisms to lock one of the rebar intersections into the holding portion; and c) the locking mechanisms of the holding portion and the locking cap engaging each other about said one of the rebar intersections to interconnect the holding portion with the rebar lattice and maintain the apparatus in an upright position with respect to the rebar lattice.

2. The apparatus of claim 1, further comprising:

a) the holding portion having an open ended recess with two opposing walls and being generally U-shaped, the recess having a longitudinal axis and being sized and shaped to receive a longitudinal rod;

b) an arc-shaped portion extending outward from each opposing wall and perpendicular to the longitudinal axis of the recess, the arc-shaped portion having a first side, a second side and a transverse axis, the arc-shaped portion being sized and shaped to receive a transverse rod;

c) the arc-shaped portion having a recess and opposing walls with one wall including one of the plurality of base member locking mechanisms, the locking mechanism being capable of inward deflection;

d) the locking cap including a cap locking mechanism for engaging the base member locking mechanism of the arc-shaped portions, the locking cap being formed of one piece and having a generally arc-shaped portion; and e) the leg portion having a base portion connected to the leg portion distal to the holding portion.

3. The apparatus of claim 1, wherein the holding portion includes a notch having a semi-circular recess that ends in a lip portion, the notch being configured to allow for a locking engagement of a cylindrical bar that is snapped into the notch.

4. The apparatus of claim 1, wherein the leg portion is formed of two interconnected leg portions, the two leg portions having a generally X-shaped cross-section.

5. The apparatus of claim 1, wherein the locking cap has a top side, a bottom side, and is generally rectangular in shape, the arc-shaped portion being placed on the bottom side, along the length of the locking cap, the top side includes a plurality of lateral reinforcing ribs.

6. The apparatus of claim 1, wherein a base portion is integrally attached to the leg portion.

7. The apparatus of claim 6, wherein the base portion is generally circular in shape and dimensioned to provide a stable support for the apparatus when placed on unstable or soft roadbeds or other unstable foundations.

8. The apparatus of claim 6, wherein the leg portion extends into a plurality of tapering rib portions on the base, the rib portions providing stability and strength to the base.

9. The apparatus of claim 6, wherein the base portion tapers to a knob having a diameter that is smaller than a diameter of the leg portion.

10. The apparatus of claim 6, wherein the base portion has an upper and a lower surface, the lower surface including a spike portion extending downwardly from the base portion, the spike portion being sized and shaped to allow the apparatus to be securely positioned in lateral and sloping surfaces.

11. The apparatus of claim 1, wherein the holding portion and leg portion are integrally formed of a material selected from the group consisting of nylon and polypropylene and polyethylene.

12. The apparatus of claim 1, wherein the base locking cap further comprises:

a leg portion extending from and perpendicular to the base locking cap proving spacing between the holding portion of the base member and a holding portion of the base locking cap;

the holding portion of the base locking cap being attached to the leg portion distal to the base locking cap and having recesses to receive a rebar intersection of a second rebar lattice; and a one piece top locking cap having a plurality of locking mechanisms for engaging the locking mechanism of the holding portion of the base locking cap for locking the rebar intersection of the second rebar lattice.

13. The apparatus of claim 12, wherein the holding portion of the base locking cap further includes:

an open ended recess with two opposing walls and being generally U-shaped, the recess having a longitudinal axis and sized and shaped to receive a longitudinal rod;

an arc-shaped portion extending outward from each opposing wall and perpendicular to the longitudinal axis of the recess, the arc-shaped portion having a transverse axis and sized and shaped to receive a transverse rod;

the arc-shaped portion having a recess and opposing walls with each wall including a locking mechanism, the locking mechanism being capable of inward deflection.

14. The apparatus of claim 13, wherein the locking cap further includes locking mechanisms for engaging the locking mechanisms of the arc-shaped portions, the locking cap having a generally arc-shaped portion.

15. The apparatus of claim 14, wherein the apparatus secures the longitudinal and transverse rebar intersections of the rebar lattice, the holding portion of the apparatus allowing the longitudinal rods to deflect upwardly when subject to rotational torque, thereby preventing the inward deflecting of the locking mechanism on the arc-shaped portion, thereby maintaining the apparatus in the upright position.

16. An apparatus for fixating and elevating mats of an assembled rebar lattice having intersections of longitudinal and transverse rebar rods for support of poured concrete, comprising:

a) a holding portion having an open ended recess with two opposing walls and being generally U-shaped, the recess having a longitudinal axis and being sized and shaped to receive a longitudinal rod;

b) an arc-shaped portion extending outward from each opposing wall and perpendicular to the longitudinal axis of the recess, the arc-shaped portion having a first side, a second side and a transverse axis, the arc-shaped portion being sized and shaped to receive a transverse rod;

c) the arc-shaped portion having a recess and opposing walls with one wall including a locking mechanism, the locking mechanism being capable of inward deflection;

d) a one piece locking cap including a plurality of locking mechanisms for engaging the locking mechanisms of the arc-shaped portions, the locking cap having a generally arc-shaped portion;

e) a leg portion extending from the holding portion with a base portion connected to the leg portion;

f) the holding portion of the apparatus allowing the longitudinal rods to deflect upwardly when subject to rotational torque, thereby preventing the inward deflecting of the locking means on the arc-shaped portion;

g) whereby the locking mechanisms of the holding portion and the locking cap engaging each other about the rebar intersection in the assembled rebar lattice to interconnect the holding portion with the rebar lattice and maintain the apparatus in an upright position.

17. The apparatus of claim 16, wherein the holding portion includes a notch having a semi-circular recess that ends in a lip portion, the notch receiving a cylindrical bar that is snapped into the notch.

18. The apparatus of claim 16, wherein the leg portion is formed of two interconnected leg portions, the two leg portions having a generally X-shaped cross-section.

19. The apparatus of claim 16, wherein the locking cap has a top side, a bottom side, and is generally rectangular in shape, the arc-shaped portion being placed on the bottom side, along the length of the locking cap, the top side includes a plurality of lateral reinforcing ribs.

20. The apparatus of claim 16, wherein the base portion is generally circular in shape and dimensioned to provide a stable support for the apparatus when placed on unstable or soft roadbeds or other unstable foundations.

21. The apparatus of claim 16, wherein the leg portion extends into a plurality of tapering rib portions on the base, the rib portions providing stability and strength to the base.

22. The apparatus of claim 16, wherein the base portion tapers to a knob having a diameter that is smaller than a diameter of the leg portion.

23. The apparatus of claim 16, wherein the base portion has an upper and a lower surface, the lower surface including a spike portion extending downwardly from the base portion, the spike portion being sized and shaped to allow the apparatus to be securely positioned in lateral and sloping surfaces.

24. The apparatus of claim 16, wherein the holding portion, leg portion and base portion are integrally formed of a material selected from the group consisting of nylon and polypropylene and polyethylene.

25. The apparatus of claim 16, wherein the base locking cap further comprises:

a leg portion extending from and perpendicular to the base locking cap providing spacing between the holding portion of the base member and a holding portion of the base locking cap;

the holding portion of the base locking cap being attached to the leg portion distal to the base locking cap and having recesses to receive the individual longitudinal and transverse rebar intersections of a second set of rebar lattice; and a one piece top locking cap having a plurality of locking mechanisms for engaging the holding portion locking mechanisms of the base locking cap for locking the individual longitudinal and transverse rebar intersections of the second set of rebar lattice.

26. The apparatus of claim 25, wherein the base locking cap holding portion further includes an open ended recess with two opposing walls being generally U-shaped, the recess having a longitudinal axis and being sized and shaped to receive a longitudinal transverse rod;

an arc-shaped portion extending outward from each opposing wall and perpendicular to the longitudinal axis of the recess, the arc-shaped portion having a transverse axis and being sized and shaped to receive a transverse rod;

the arc-shaped portion having a recess and opposing walls with each wall including a locking mechanism, the locking mechanism being capable of inward deflection of the locking mechanism.

27. The apparatus of claim 26, wherein the top locking cap further includes locking mechanism for engaging the locking mechanism of the arc-shaped portions, the locking cap having a generally arc-shaped portion.

28. The apparatus of claim 27, wherein the apparatus secures the longitudinal and transverse rebar intersections of the rebar lattice, the holding portion of the apparatus allowing the longitudinal rods to deflect upwardly when subject to rotational torque, thereby preventing the inward deflecting of the locking mechanisms on the arc-shaped portion, thereby maintaining the apparatus in the upright position.

29. The apparatus of claim 16, wherein the mats of assembled rebar lattice comprise:

vertically spaced mats of rebar lattices.

30. A system for fixating and elevating mats of assembled rebar lattice having intersections of longitudinal and transverse rebar rods for support of poured concrete, said system comprising a chair at selected rebar intersections, each of said chairs comprising:

a) a base member comprising:

1) a plurality of holding portions each having a plurality of locking mechanisms and having recesses to receive individual longitudinal and transverse rods of each rebar intersection of a rebar mat;

2) a leg portion extending from each of the plurality of holding portions for spacing above a surface to receive the concrete;

b) a plurality of locking caps each having locking mechanisms for engaging the holding portion locking mechanisms to lock the individual longitudinal and transverse rebar intersections into the recesses of each holding portion;

c) the system securing a plurality of individual longitudinal and transverse rebar intersections; and d) the locking mechanisms of the holding portions and the locking caps engage each other about the rebar intersections of the rebar lattice to interconnect the holding portions with the rebar lattice and maintain each of the chairs in an upright position with respect to the rebar lattice, with the system of chairs providing resistance against angular deflection of the rebar lattice structure when the rebar lattice structure is subject to the forces of a concrete pour.

31. The system of claim 30, wherein the mats of assembled rebar lattice comprise:

vertically spaced mats of rebar lattices.

* * * * *